US005381297A

United States Patent [19]

Weber

[11] Patent Number: 5,381,297

[45] Date of Patent: Jan. 10, 1995

[54] SYSTEM AND METHOD FOR OPERATING HIGH SPEED SOLENOID ACTUATED DEVICES

[75] Inventor: Robert E. Weber, Newport News, Va.

[73] Assignee: Siemens Automotive L.P., Auburn Hills, Mich.

[21] Appl. No.: 79,140

[22] Filed: Jun. 18, 1993

[51] Int. Cl.[6] ..... H01H 47/00

[52] U.S. Cl. ..... 361/153; 361/154

[58] Field of Search ..... 361/139, 143, 152, 153, 361/154; 123/490

[56] References Cited

U.S. PATENT DOCUMENTS 4,359,652 11/1982 Jarrett et al. ..... 361/153
4,536,818 8/1985 Nielsen ..... 361/154
4,729,056 3/1988 Edwards et al. ..... 361/153
4,823,825 4/1989 Buchl ..... 361/152
5,120,143 6/1992 Fujiwara et al. ..... 361/153
5,182,517 1/1993 Thelen et al. ..... 361/152

*Primary Examiner*—Jeffrey A. Gaffin
*Attorney, Agent, or Firm*—Russel C. Wells; George L. Boller

[57] ABSTRACT

A system and method for operating high speed solenoid actuated devices such as electromagnetically operated high pressure fuel injectors require an initial high power boost to start the movement of an armature followed by a medium power boost to continue the movement of the armature to its end position and a low power control to hold the armature at its end position so that when the power is removed, the armature returns to its rest or beginning position. The system here details the logic and control necessary to provide six stages of power control, including both voltage and current control, to accomplish high speed operation both in moving the armature from its beginning to end position but also to return the armature from its end to its beginning position.

12 Claims, 4 Drawing Sheets

SYSTEM AND METHOD FOR OPERATING HIGH SPEED SOLENOID ACTUATED DEVICES

FIELD OF THE INVENTION

This invention relates to electronic control power circuit systems in general and more particularly to a power circuit system for operating high pressure fuel injectors wherein the circuit provides a low current signal processing system controlling the application of both a boost voltage and a normal voltage with a controlled voltage waveform.

BACKGROUND OF INVENTION

The inherent nature of a solenoid actuated device imposes a finite delay in its response to the application of a voltage to the device. For certain types of devices, such as a fuel injector that directly injects fuel into a combustion chamber of a two-stroke internal combustion engine, commonly called a high pressure fuel injector, it becomes quite important not only to minimize this delay, but to keep the minimized delay time constant. Yet, it is equally important not to have a high current in the solenoid coil at turnoff, as again due to the inherent nature of a solenoid actuated device, this also imposes another delay when the voltage is removed. The larger the amount of energy that must be dissipated upon solenoid turnoff, the longer the delay.

The present invention relates to a switch mode circuit that responds to a pulse input signal. The pulse input signal commands actuation of the solenoid actuated device, such as the high pressure fuel injector and the circuit creates a particular shaped voltage waveform across the solenoid coil. This voltage waveform controls a current through the solenoid coil that is effective to actuate the device with improved quickness. Once actuated, the circuit causes the amount of current to drop, at a controlled rate, to a hold level that is sufficiently high to assure that the solenoid remains actuated but at the same time is sufficiently low to assure that the energy will be dissipated quickly when the pulse signal is removed.

The invention is embodied in an electronic control power circuit system which comprises a low-current signal processing portion and a high power switching portion that controls the current through the solenoid coil in accordance with the control provided by the signal processing portion. While the preferred embodiment of the invention comprises its signal processing portion constructed from discrete electronic circuit components, it should be understood that such signal processing may be performed in an equivalent way by the use of a microprocessor that executes suitable algorithms for performing the equivalent functions performed by the disclosed signal processing portion.

SUMMARY OF THE INVENTION

A method for operating high speed solenoid actuated devices such as high pressure fuel injectors in an internal combustion engine having the steps of generating an actuation pulse having a time duration equal to the total time the device is to be actuated. The time duration is divided into five time stages. During the first stage of the actuation pulse and in response to the leading edge of the actuation pulse, a first voltage level is coupled to the solenoid actuated device to generate a current therethrough to begin moving of the solenoid device armature from its rest position. The peak value of the current is detected during the first stage; and in response thereto the first voltage is de coupled from the solenoid actuated device for a second stage period of time.

During the second stage the current decays to a second value less than the peak-value providing sufficient power to continue the movement of the armature. During the period of time comprising a third stage, a switched normal voltage is applied to solenoid actuated device for continuing the current through the solenoid to maintain the movement of the armature to its end position. At the end of third stage and during the fourth stage, the normal voltage is de coupled from the solenoid actuated device causing the current to decay from the second value to a third value.

During the period of time comprising a fifth stage, the switched normal voltage is applied to the solenoid actuated device for reducing the current through the solenoid to magnetically hold the armature at its end position. The switched normal voltage is removed from the solenoid actuated device, during the period of time comprising a sixth stage to provide a polarity reversal of the voltage in the solenoid actuated device to a fifth voltage level to dissipate the electromagnetic field in the solenoid to return the armature means to its rest position.

DETAILED DESCRIPTION OF THE DRAWINGS

DESCRIPTION OF THE PREFERRED EMBODIMENT

Figure 2:
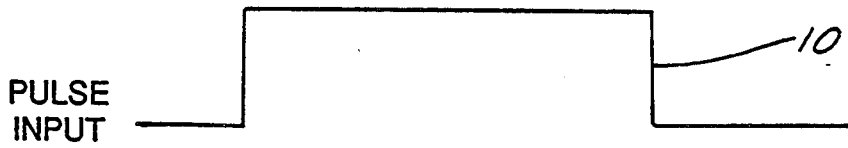
FIG. 2 is the waveform for the input pulse.
Figure 3:
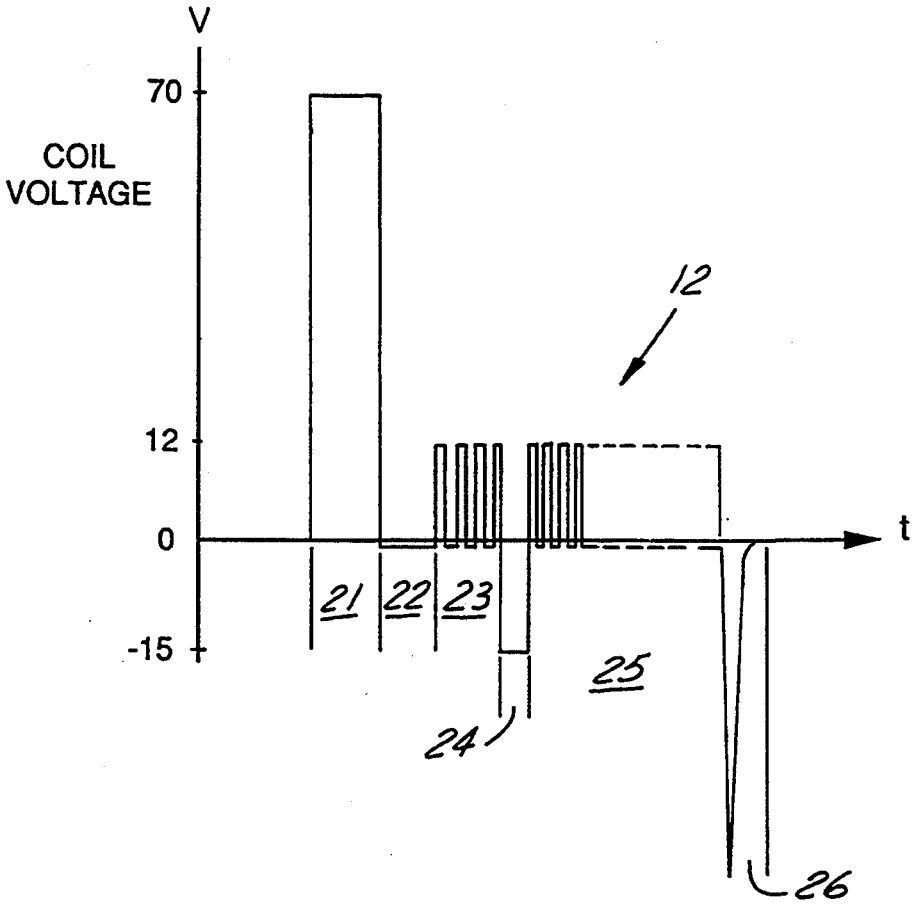
FIG. 3 is the waveform of the solenoid coil voltage.
Figure 4:
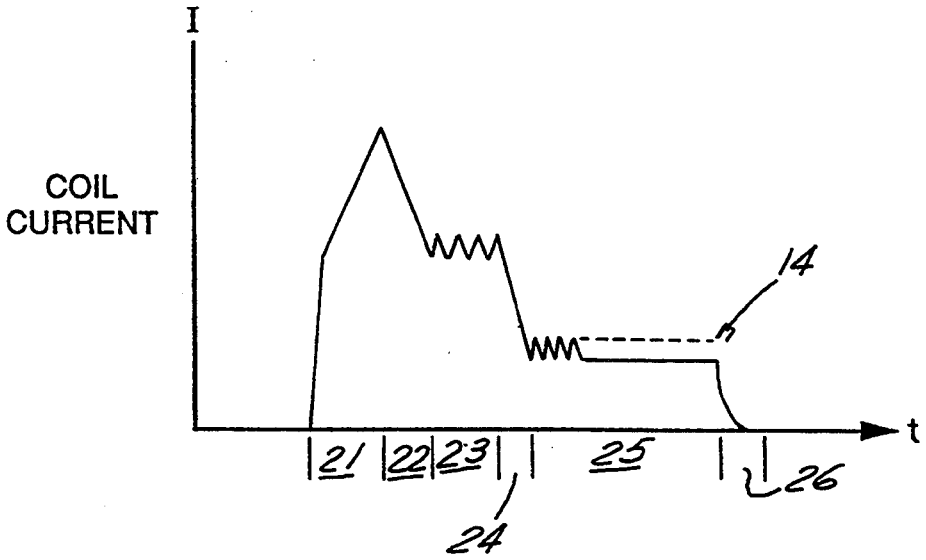
FIG. 4 is the waveform of the current through the solenoid coil.
Figure 5A:
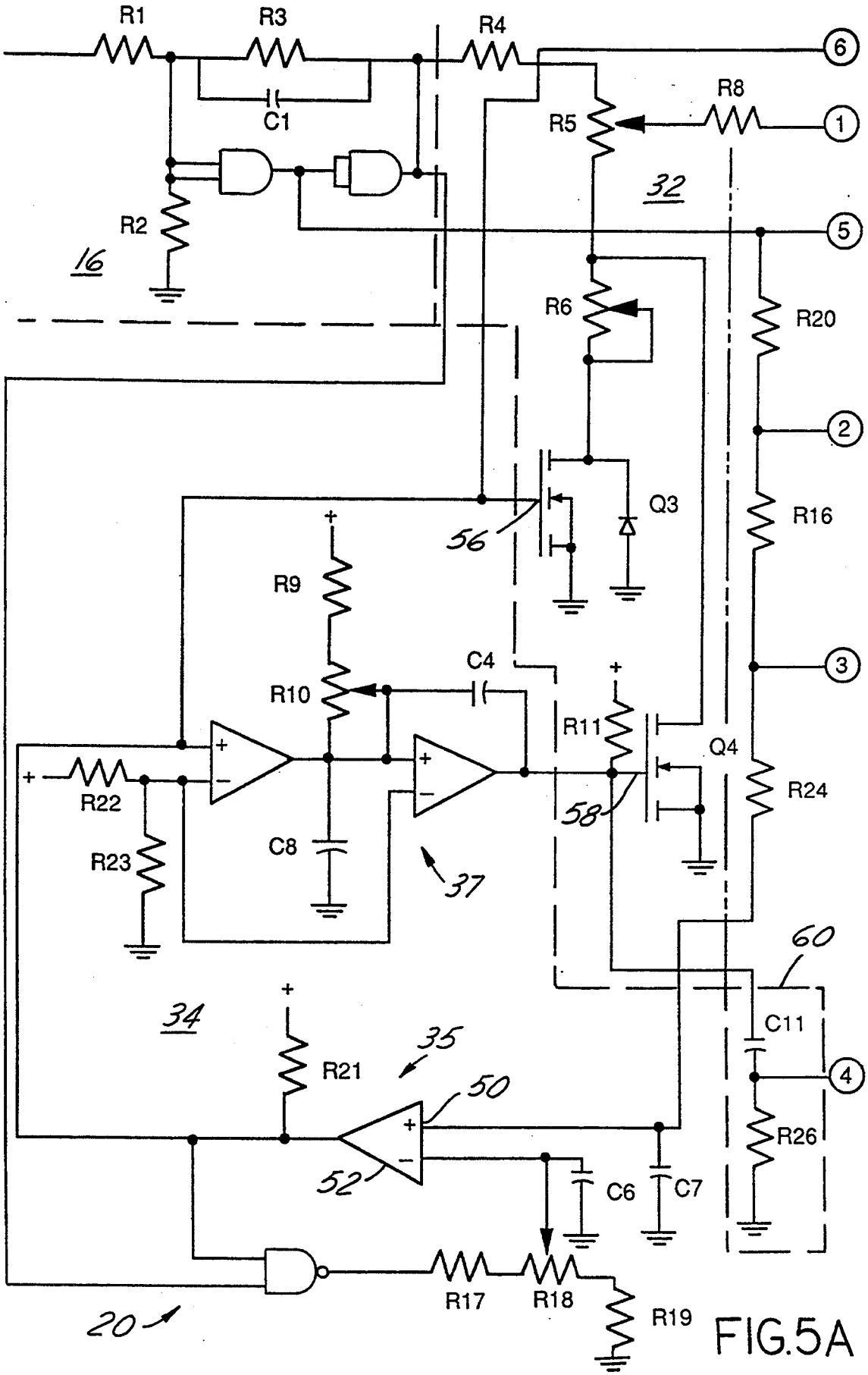
FIG. 5A and 5B are schematics of the circuit.
Figure 5B:
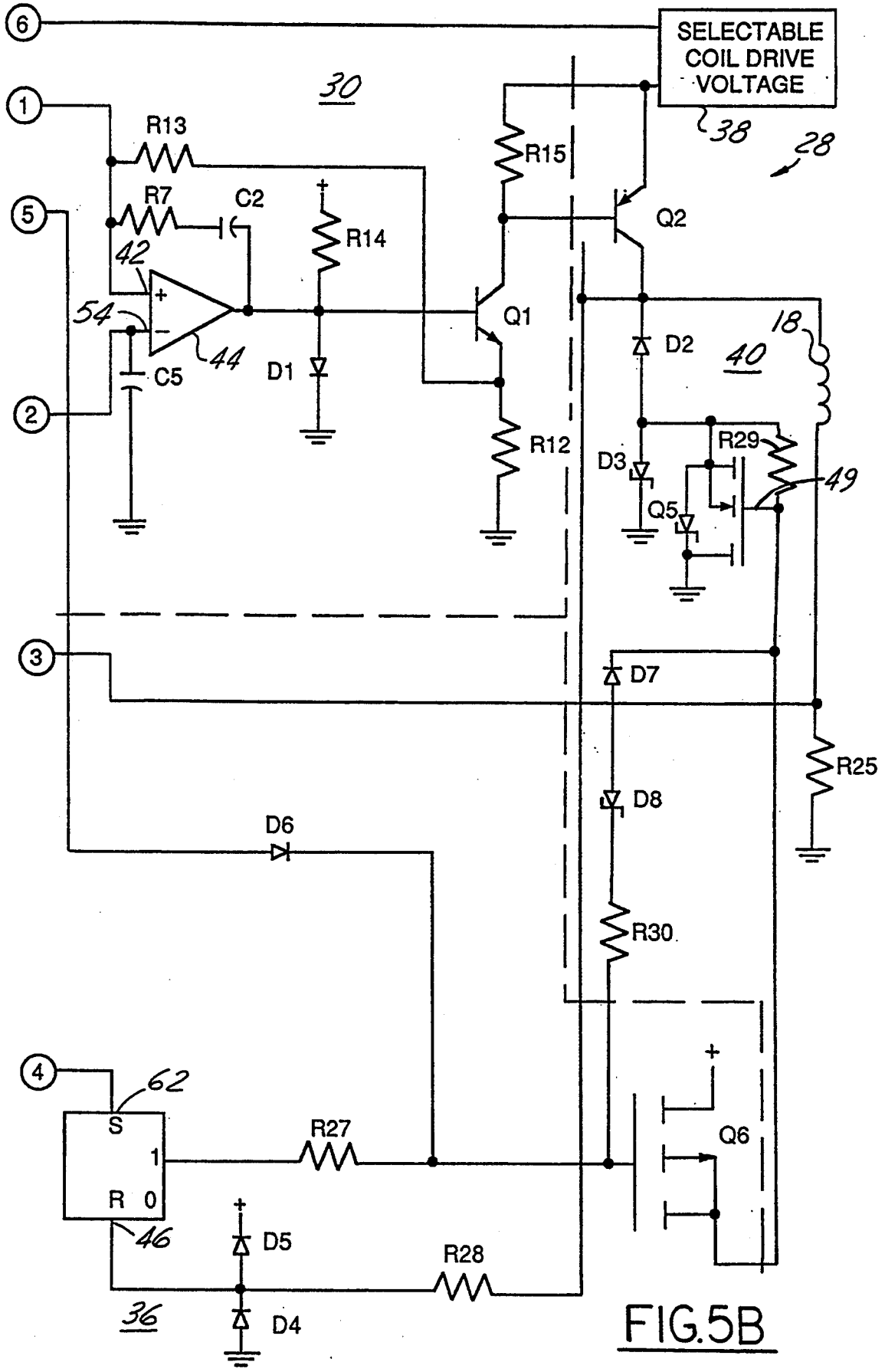

The main waveforms of the circuit of FIG. 5 illustrated in Cartesian coordinate system in FIGS. 2, 3 and 4. The abscissa of each of the three waveforms 10, 12, 14 represents the same time scale so that the relationship of the waveforms is better understood. FIG. 2 illustrates the pulse input waveform 10 to the circuit which is shaped by the input noise filter and shaper 16. As is noted this is a typical square wave pulse input and in particular in the preferred embodiment it has an actuation time duration that varies from 250 microseconds to 3 milliseconds in length.

FIG. 3 illustrates the voltage waveform 12 in the high power portion at the solenoid coil 18 as generated by the low current signal processing circuit 20 in response to the input waveform of FIG. 2. This waveform illustrates six stages 21, 22, 23, 24, 25, 26 of voltage shaping. The first stage 21 is a high voltage boost at the beginning of the waveform 12, to a first voltage level namely seventy volts. In the second stage 22, the voltage is removed and clamped by means of a negative voltage clamp to a third voltage level of about -0.6 volts referenced to a second voltage level which is ground. In the third stage 23, a switched or chopped voltage of twelve volts which is a normal voltage level, is applied to the solenoid coil 18. At the end of the third stage, the fourth stage 24 illustrates the voltage clamped to a negative fifteen volts which is a fourth voltage level. The fifth stage 25 is the application of switched normal voltage level, twelve volts, until the end of the input pulse 10 when the power is turned off and in the sixth stage 26, the solenoid coil 18 voltage spikes to a fifth voltage level which is a large negative value, approximately seventy-five volts, to quickly dissipate the electromagnetic energy in the solenoid coil 18. The summation of the first five time stages is equal in total to the actuation time of the input pulse.

FIG. 4 illustrates the current waveform 14 corresponding to each of the previously identified six waveform stages of the voltage waveform. In the first voltage waveform stage 21, the current rises to a peak current of ten amperes. When this peak current is sensed, the second voltage waveform stage 22 is generated to cause the peak current to decay under controlled conditions. This decay time lasts until the third voltage waveform stage 23 when the coil current is maintained at a second current level of approximately six amperes. This level is called the dwell level. When the voltage waveform goes to its fourth stage 24, the second current level quickly decays under controlled conditions, to a third current level or hold current level, about three amperes, which is maintained in the fifth stage 25 until the input pulse 10 ends. It is necessary that the decay when the pulse ends be quick in order to cover the full range of input pulse times for accurate fuel flows from the injector. It is also important when the current decays from a higher level to a lower level, there be no undershoot. During the sixth stage 26 when the coil voltage rapidly decays to the fifth voltage level to dissipate the electromagnetic energy in the solenoid coil 18, the current decays to zero.

Figure 1:
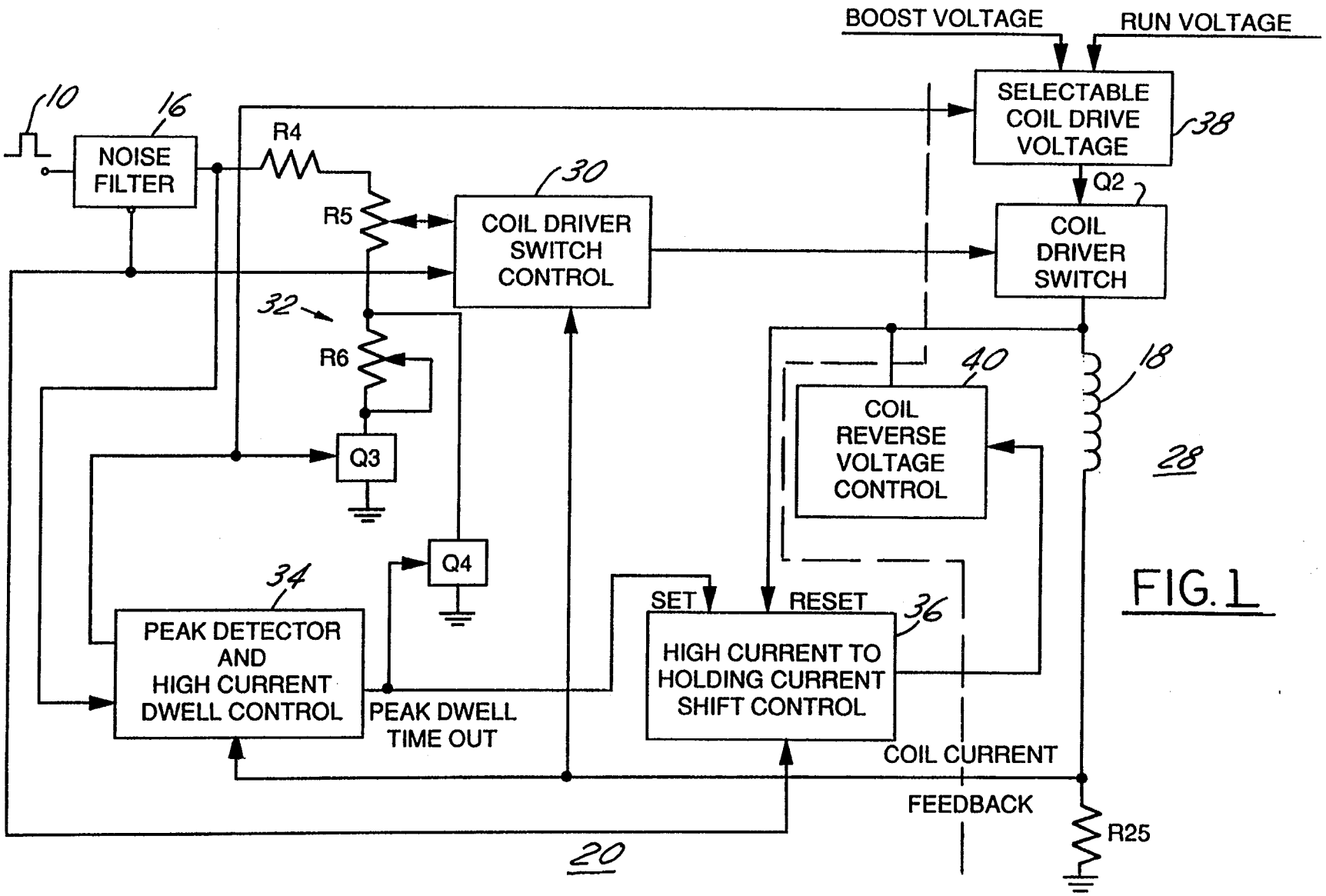
FIG 1 is block diagram of the circuit.

Referring to the general block diagram of FIG. 1, the circuit comprises a low current signal processing system 20 and a power switching system 28 including the solenoid coil 18. The low current signal processing system 20 comprises a noise filter and shaper circuit 16, a coil driver switch control means 30, a bias switching circuit 32, a peak current detector and high current dwell control 34 and high current shift control 36. The power switching system 28 comprises a selectable coil drive voltage and control system 38, a power switch Q2 and a coil reverse voltage control system 40 including a coil current feedback resistor R25. The solenoid coil 18 represents the solenoid in the device being controlled such as a high pressure fuel injector for use in a motor vehicle.

Referring to FIG I and FIG. 5A which is the low current signal processing circuit 20, an input pulse 10 as illustrated in FIG. 2, is supplied to an input resistor R1 in the noise filter and shaper circuit or noise filter 16. The function of the noise filter 16 is to both remove any unwanted noise from the input pulse and to shape the pulse to be applied to the circuit. The output of the noise filter 16 is supplied through resistor R4 to input resistor R8 and to the non inverting input 42 of a first comparator 44 in the coil driver switch control means 30 and through first and second variable resistors R5 and R6 to first and second switch control transistors Q3 and Q4 in the bias switching circuit 32. In addition the output of the noise filter is also supplied to enable the second comparator 52 in the peak detector 34. When the current signal reaches a predetermined level, a high output pulse is provided from the second comparator 52.

An inverted input pulse, that is high when the input pulse is not present, is supplied through the diode D6 to the current shift control to insure that the output transistor Q6 in the shift control circuit 36 is reset at the start of the fuel injection pulse. In addition the inverted input pulse is connected through the resistor R20 to the inverting input 54 and to condition the first comparator 44.

The output of the bias switching circuit 32 functions to control the bias level to the coil driver switch control means 30. With both switch control transistors Q3 and Q4 off, the output pulse from the noise filter 16 controls the peak level or first stage 21 of the voltage waveform 12 of FIG 3. With the first switch control transistor Q3 on or conducting, supplying ground or the second voltage level to the tap on the second variable resistor R6, the output signal of the noise filter 16 controls the peak dwell level or third stage 23 of the voltage waveform 12 of FIG. 3 and with the second switch control transistor Q4 on or conducting, shorting out the second variable resistor R6, the current determined by the first variable resistor R5 controls the hold or third current level, the fifth stage 25 of the current waveform 14 of FIG. 3.

The output stage of the coil driver switch control means 30 is a switching transistor Q1 controlling the operation of the switching power transistor Q2 in the coil driver switch. The coil driver switch is connected a selectable coil driver voltage and control system 38 to receive the range of voltages, either boost or first voltage level or a normal or run voltage level, to be supplied through the coil driver switch transistor Q2 to the solenoid coil 18. The output of the coil driver switch Q2 is connected to the solenoid coil, through diode D2 to the coil reverse voltage control system 40 and through the resistor R28 to the reset input 46 of a flip flop 48 in the current shift control circuit 36.

The coil reverse voltage control system 40 receives an input signal at the gate 49 of transistor Q5 from the output transistor Q6 of the current shift control circuit 36 turning on the transistor Q5 thereby providing the negative voltage clamp equal to the diode drop of D2, approximately 0.6 volts, as shown in the second stage 22 of the voltage waveform 12. The function of the coil reverse voltage control system 40 is to control the current through the solenoid coil 18 at each of the several current waveform stages 21–26 of the current waveform 14.

A coil current feedback signal, responsive to the amount of current flowing through the solenoid coil 18, is generated by the voltage drop across resistor R25 connected in series with solenoid coil. This feedback signal is supplied through resistor R24 to the non-inverting input 50 of a second comparator 52 in the peak detector circuit portion 35 of the peak detector and high current dwell control circuit 34. Upon receipt of the noise filter output pulse, the second comparator 52 is enabled allowing the current signal, when it reaches a predetermined level, or peak current level, as determined by the resistors R17–R19 and the capacitor C6, to provide a high output pulse from the second comparator 52. The high output from the second comparator is supplied to the first switch control transistor Q3 which turning on lowers the input voltage on the first comparator 44. In addition, the output from the second comparator 52 is supplied to the selectable coil drive voltage control 38 to turnoff the boost voltage. The peak current decays to the peak dwell level, in the second stage 22 where it is maintained until the voltage level at the non inverting input 42 of the first comparator 44 is lowered by action of the second switch control transistor Q4.

The coil current feedback signal is also supplied through resistor R16 to the inverting input 54 of the first comparator 44 in the coil driver switch control circuit 30. The peak current detector 35 senses the maximum current level in the first stage 21 of the current waveform 14. This current operates to energize the solenoid coil 18 to start the armature means, not shown, moving from its rest position. The current levels in the second and third stages 22 and 23 of the current waveform 14 operate to continue the movement of the armature to its end position.

The output of the second comparator 52 in the peak detector circuit 35 is supplied to the high current dwell control portion 37 of the peak current detector and high current dwell control circuit 34 and to the gate 56 of the first switch control transistor Q3. The output of the second comparator 52 is also supplied to the selectable voltage and control system 38 to end the first stage 21 shown on the voltage waveform 12 and to switch the voltage applied to the coil driver switch Q2 from the boost voltage to the run voltage. The output signal of the high current dwell control system 37 is a time delayed signal that is supplied to the gate 58 of the switching transistor Q4 and through an RC circuit 60 comprising a capacitor C11 and a resistor R26, to the set input 62 of the flip flop 48 in the current shift control circuit 36. The time delay through the high current dwell is represented by the second and third stages 22 and 23 as shown on the current waveform 14. At the end of the third stage 23, the output signal of the high current dwell control 37 is applied to the set input 62 of the flip flop 48. This functions to turn on the output transistor Q6 applying a positive voltage to the gate 49 of transistor Q5 in the coil reversing voltage control circuit 40. This allows the fourth stage of the voltage waveform 12 to go negative to the value of the zener diode D3 which is approximately seventy volts.

The output of the first comparator 44 turns on the coil driver switch Q1 to supply voltage to the solenoid coil 18. Upon receipt of the noise filter output pulse, the second comparator 52 is enabled allowing the current signal, when it reaches a predetermined level, to provide a high output pulse from the second comparator 52. The high output from the second comparator is supplied to the first switch control transistor Q3 which turning on lowers the input voltage on the first comparator 44 and is supplied to the selectable coil drive voltage control 38 to turnoff the boost voltage. The peak current decays to the peak dwell level, in the second stage 22 where it is maintained until the voltage level at the non inverting input 42 of the first comparator 44 is lowered by action of the second switch control transistor Q4.

The high output from the second comparator is supplied to a timer circuit which after timing out, turns on the second switch control transistor to lower the voltage level supplied to the input of the first comparator. This results in lowering the solenoid coil voltage to a hold voltage level. The timer's function is to provide the time from the peak current level to the hold current level, the time of the second and third voltage waveform stages, allowing the peak dwell level to supply current for a long enough period of time to fully actuate the high pressure injector.

The function of the coil driver switch control circuit is to control the power switching transistor in the coil driver circuit. When the input pulse begins, as previously mentioned, it actuates the drive voltage select logic circuit to supply the boost voltage to the coil driver switch circuit. At the same time the input pulse actuates the coil driver switch control circuit through the first comparator to turn the low power switching transistor on which turns on the coil driver switch circuit. Since the boost voltage is being supplied to the coil driver switch, the boost voltage stays on, the first stage of the voltage waveform, the coil until the peak detector senses the peak current and supplies a signal to turn-off the switching transistor.

This turns off the voltage to the coil and through the coil reverse voltage control circuit, or suppression circuit, in parallel with the solenoid coil, the voltage drops to a slightly negative voltage, approximately 0.6 volts, which is the second stage of the voltage waveform. The control circuit from the first comparator to the low power switching transistor provides hysteresis control of the input to the comparator and this hysteresis provides the timing of the second stage. Once the input to the first comparator is sufficient to produce an output signal effective to turn on the switching transistor, feedback in the circuit, as is well known, causes the switching transistor to switch on and off during the third stage or the peak dwell time. As a result of the switching, the current is maintained at a level to make sure that the injector is fully actuated.

When the timer times out, the bias on the first comparator is changed and also the high current to holding current shift control circuit is set. This operates to control the coil reverse voltage control circuit. At the end of the third stage of the voltage waveform, the switching transistors are turned off and the voltage across the coil is allowed to swing to a negative voltage level under control of the suppression circuit. The suppression circuit has an active field effect transistor which limits the swing of the voltage due to the turnoff. Controlling the field effect transistor in the high current to holding current shift control circuit is the flip flop 48. The function of the flip flop 48 is to allow the suppression circuit to have the current through the coil decay from the peak dwell level to the holding current level without undershoot at the end of the fourth stage. When the flip flop 48 times out, the field effect transistor is turned on and the switching transistors are turned on to supply the run voltage to the coil.

Again during the fifth stage, the switching transistors are operated in a pulsing on-off mode due to the hysteresis in the coil drive switch control circuit. This continues until the input pulse to the noise filter is removed and the switching transistors are turned off. With the field effect transistor in the suppression circuit turned off, a high voltage zener diode allows the voltage to swing across the solenoid coil from the run voltage to the negative value of the zener diode, which in the preferred embodiment is seventy five volts. As is well known, the coil energy dissipates and the solenoid coil is deactuated and the armature means returns to its rest position.

The removal of the input pulse operates to reset the fuel injector driver system to its normal state in readiness for the next operational input pulse.

I claim:

1. An electronic power control system for actuating a solenoid operated device for controlling at least three levels of current, namely peak level, dwell level and hold level, applied to the solenoid operated device having an armature means, the control system comprising:

an input means for receiving an input pulse indicating the actuation time of a solenoid operated device comprising a solenoid coil and generating an actuation pulse having five time stages;

a coil driver switch control means operatively coupled to said input means and responsive to the leading edge of said actuation pulse for controlling a switch for applying a first voltage level for a first stage time period to the solenoid operated device to generate an electromagnetic field in the solenoid to initiate movement of the armature means from its rest position toward its end position; peak current detection means responsive to the magnitude of the current flowing through the solenoid coil for generating an electrical signal representing the peak current, said electrical signal representing the peak current operable to remove said first voltage level for a second stage time period for reducing the current flowing through the solenoid coil;

time delay means responsive to said electrical signal representing the peak current for generating a dwell level current electrical signal at the end of said delay, said dwell level current electrical signal operable to apply a normal voltage to the solenoid coil for a third stage predetermined time period to continue the electromagnetic field in the solenoid coil for maintaining the movement of the armature means to its end position;

de coupling means responsive an end of said dwell level current electrical signal for de coupling said normal voltage from the solenoid coil for a fourth stage predetermined time causing said dwell level current to decrease to a lower hold level current; means responsive to said lower hold level current for applying said normal voltage to the solenoid coil to continue the electromagnetic field in the solenoid coil for maintaining the armature means at its end position for a fifth stage time period; and means responsive to the trailing edge of said actuation pulse to remove said normal voltage from the solenoid coil allowing the induced the electromagnetic field in the solenoid coil for returning the armature means to its rest position.

2. An electronic power control system for actuating a solenoid operated device according to claim I wherein the first voltage level is a boost voltage and is substantially higher than the normal voltage level which is the basic power supplied voltage for operating the solenoid actuated device.

3. An electronic power control system for actuating a solenoid operated device according to claim 1 wherein removing the first voltage comprises a negative voltage clamp clamped to a second voltage level for changing the first voltage level to a third voltage level.

4. An electronic power control system for actuating a solenoid operated device according to claim 3 wherein the value of the second voltage level is zero.

5. An electronic power control system for actuating a solenoid operated device according to claim 1 wherein removing the normal voltage level comprises a negative voltage, clamp clamped to a second voltage level for changing the normal voltage level to a fourth voltage level.

6. An electronic power control system for actuating a solenoid operated device according to claim 5 wherein the value of the second voltage level is zero and the third predetermined voltage level is less negative than the fourth voltage level which is less negative than the value of the fifth voltage level.

7. A method for operating high speed solenoid actuated device such as a high pressure fuel injector having a solenoid coil in an internal combustion engine, the method comprising the steps of:

generating an actuation pulse having a time duration equal to the total time the solenoid coil is to be actuated, the time duration being divided into five time stages;

coupling, during a first stage of the actuation pulse and in response to the leading edge of the actuation pulse, a first voltage level to the solenoid coil to generate a current through the solenoid coil, said current operable to begin moving of the solenoid device armature from its rest position;

detecting the peak value of the current during the first stage;

de coupling, in response to the peak value, the first voltage level from the solenoid coil for a period of time comprising a second stage causing the current to decay to a second value less than the peak value providing sufficient power to continue the movement of the armature;

applying, during the period of time comprising a third stage, a switched normal voltage level to solenoid coil for maintaining the current through the solenoid coil to maintain the movement of the armature to its end position;

de coupling the normal voltage level from the solenoid coil for a period of time comprising a fourth stage causing the current to decay from the second current value to a third current value;

applying, during the period of time comprising a fifth stage, the switched normal voltage level to solenoid coil for reducing the current through the solenoid coil to the third current value to magnetically hold the armature at its end position; and then removing the switched normal voltage from the solenoid coil, to provide a polarity reversal of the voltage in the solenoid coil to a fifth voltage level to dissipate the magnetic field in the solenoid coil to return the armature to its rest position.

8. The method for operating high speed solenoid actuated device such as a high pressure fuel injector in an internal combustion engine according to claim 7 wherein the first voltage level is a boost voltage and is substantially higher than the normal voltage level which is the basic power supplied voltage for operating the solenoid actuated device.

9. The method for operating high speed solenoid actuated device such as a high pressure fuel injector in an internal combustion engine according to claim 7 wherein the step of de coupling the first voltage level, the polarity reversal of the first voltage level is controlled to a third voltage level by means of a negative voltage clamp clamped to a second voltage level.

10. The method for operating high speed solenoid actuated device such as a high pressure fuel injector in an internal combustion engine according to claim 9 wherein the value of the second voltage level is zero.

11. The method for operating high speed solenoid actuated device such as a high pressure; fuel injector in an internal combustion engine according to claim 7 wherein the step of de coupling the normal voltage level, the polarity reversal of the normal voltage is controlled to fourth voltage level by means of a negative voltage clamp to the second voltage level.

12. The method for operating high speed solenoid actuated devices such as a high pressure fuel injector in an internal combustion engine according to claim 11 wherein the value of the third voltage level is less negative than the value of the fourth voltage level which is less negative than the value of the fifth voltage level.

* * * * *